US007820727B2

(12) United States Patent
Maretto et al.

(10) Patent No.: US 7,820,727 B2
(45) Date of Patent: Oct. 26, 2010

(54) PROCESS FOR THE RUNNING OF A REACTOR SUITABLE FOR HETEROGENEOUS REACTIONS COMBINED WITH REACTIONS TAKING PLACE IN THREE-PHASE SYSTEM

(75) Inventors: Cristina Maretto, Lodi (IT); Giovanni Pederzani, San Donato Milanese-Milano (IT)

(73) Assignees: ENI S.p.A., Rome (IT); Institut Francais du Petrole, Rueil-Malmaison (FR); Enitecnologie S.p.A., San Donato Milanese (IT)

( * ) Notice: Subject to any disclaimer, the term of this patent is extended or adjusted under 35 U.S.C. 154(b) by 0 days.

(21) Appl. No.: 12/370,682

(22) Filed: Feb. 13, 2009

(65) Prior Publication Data

US 2009/0197980 A1 Aug. 6, 2009

Related U.S. Application Data

(62) Division of application No. 10/572,516, filed as application No. PCT/EP2004/010635 on Sep. 17, 2004, now Pat. No. 7,550,515.

(30) Foreign Application Priority Data

Sep. 18, 2003 (IT) ..... MI2003A1777

(51) Int. Cl.
*C07C 27/00* (2006.01)

(52) U.S. Cl. ..... 518/700

(58) Field of Classification Search ..... 518/700
See application file for complete search history.

(56) References Cited

FOREIGN PATENT DOCUMENTS

| | | | |
|---|---|---|---|
| GB | 2223237 A | * | 4/1990 |
| WO | 03/068715 | | 8/2003 |

* cited by examiner

*Primary Examiner*—Jafar Parsa
(74) *Attorney, Agent, or Firm*—Oblon, Spivak, McClelland, Maier & Neustadt, L.L.P.

(57) ABSTRACT

Process for the running of a reactor in which reactions take place in multiphase systems, wherein a gaseous phase prevalently consisting of CO and $H_2$ is bubbled into a suspension of a solid in the form of particles (catalyst) in a liquid (prevalently reaction product), according to the Fischer-Tropsch technology.

10 Claims, 1 Drawing Sheet

PROCESS FOR THE RUNNING OF A REACTOR SUITABLE FOR HETEROGENEOUS REACTIONS COMBINED WITH REACTIONS TAKING PLACE IN THREE-PHASE SYSTEM

FIELD OF THE INVENTION

The present invention relates to a process for the running of a reactor suitable for heterogeneous reactions combined with reactions taking place in three-phase systems.

More specifically, the present invention relates to a process for the running of a reactor in which reactions take place in multiphase systems, wherein a gaseous phase, prevalently consisting of CO and $H_2$, is bubbled into a suspension of a solid in the form of particles (catalyst) in a liquid (prevalently reaction product), according to the Fischer-Tropsch technology.

DESCRIPTION OF THE BACKGROUND

The Fischer-Tropsch technology is known in literature, for preparing hydrocarbons from mixtures of gas based on hydrogen and carbon monoxide, conventionally known as synthesis gas. A document which summarizes the main works on the Fischer-Tropsch synthesis reaction is represented by Sie and Krishna, Appl. Catalysis A: General (1999), 186, 55-70.

The Fischer-Tropsch technology is typically based on the use of slurry reactors, reactors which are normally used in relation to chemical reactions which are carried out in multiphase systems in which a gaseous phase is bubbled into a suspension of a solid in a liquid. In the case of Fischer-Tropsch, the gaseous phase consists of synthesis gas, with a molar ratio $H_2/CO$ ranging from 1 to 3, the liquid phase, at the reaction temperature, prevalently consists of the reaction product, i.e. essentially linear hydrocarbons with a high number of carbon atoms, and the solid phase is prevalently represented by the catalyst.

The Fischer-Tropsch reaction is an exothermic reaction which, for its industrial embodiment, requires internal heat exchanger devices, for removing the heat produced and for controlling the thermal profile inside the reactor.

The objective of the present invention is the running of the phases which are not included in the normal operating conditions for Fischer-Tropsch reactions and which are particularly critical for the catalyst performances, such as for example:

charging;

start-up/conditioning;

make-up (subsequent additions of catalyst);

temporary or definite shut-down of the reaction section;

re-start-up after the temporary shut-down.

In scientific literature, for example in published Australian patent application AU 200066518 A1, a process is described for treating, in the charging phase, a catalyst for Fischer-Tropsch reactions which are carried in fluidized multiphase reactors and for running these during the shut-down or re-start-up phases.

SUMMARY OF THE INVENTION

The Applicants have now found an alternative process to that of the known art, for charging a catalyst into a bubble column slurry reactor and methods for the running of said reactor outside the normal operating conditions. The description of these methods is effected with the help of FIG. 1.

DETAILED DESCRIPTION OF THE INVENTION

Figure 1:
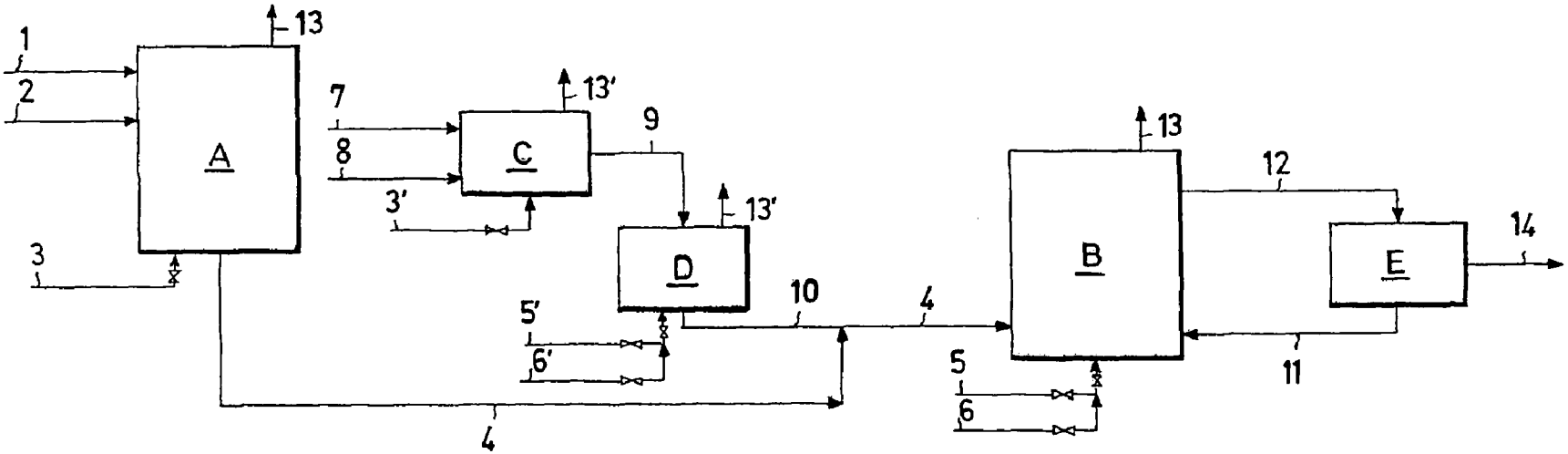
FIG. 1 is a diagram exemplifying the components and streams used in the process of the present invention.

The charging phase of a catalyst into a bubble column slurry reactor (B) at the moment of start-up, comprises:

a) incorporating the catalyst, previously reduced in a matrix of paraffinic waxes, for example in the form of pellets, tablets or granules, solid at room temperature;

b) melting and collecting the paraffinic matrix (1) in a vessel (A), maintained at a high temperature, together with a diluent (2) which is miscible with the molten paraffinic matrix and which is in liquid form both under the conditions present in the container and at room temperature, a stream of inert gas (3) being distributed in said vessel (A) from the bottom so as to obtain a sufficiently homogeneous suspension;

c) pressurizing the vessel (A), in which the complete melting of the paraffinic matrix has been effected, at a pressure higher than that of the reactor (B) maintaining the system fluidized by the continuous introduction of inert gas from the bottom of said vessel;

d) transferring, due to the pressure change, the diluted solution (4) from the vessel (A) under pressure to the reactor (B), initially empty, maintained at a temperature higher than or equal to that present in the vessel (A) flushed in turn from the bottom with inert gas (5);

e) repeating steps (b) to (d) until a suspension level is reached in the reactor (B) which is sufficient for aligning the optional external equipment (E) envisaged for the treatment of the suspension (for example, degasifier, liquid-solid separators, pumps, etc.);

f) repeating steps (b) to (d) until the normal operating suspension level is reached in the reactor (B) and in the optional external equipment (E) envisaged for the treatment of the suspension;

g) feeding the synthesis gas (6) diluted with an inert gas to the base of the reactor (B).

According to the present invention, the inert gas can consist, for example, of nitrogen or, preferably, purified natural gas.

In the present charging method, the catalyst is englobed in paraffinic waxes in the form of cylindrical blocks, wherein the quantity of wax ranges from 30 to 70% by weight. Any catalyst capable of being active in Fischer-Tropsch reactions can be used in the present process. The preferred catalyst is based on Co dispersed on a solid carrier consisting of at least one oxide selected from one or more of the following elements: Si, Ti, Al, Zr, Mg. Preferred carriers are silica, alumina or titania and their mixtures.

The cobalt is present in the catalyst in quantities ranging from 1 to 50% by weight, generally from 5 to 35% with respect to the total weight.

The catalyst can comprise further additional elements. It can comprise, for example, with respect to the total, from 0.05 to 5% by weight, preferably from 0.1 to 3%, of ruthenium and from 0.05 to 5% by weight, preferably from 0.1 to 3%, of at least a third element selected from those belonging to group 3 (IUPAC regulation). Catalysts of this type are known in literature and described, together with their preparation, in European patent 756,895.

Further examples of catalysts are again based on cobalt but containing tantalum, as promoter element, in quantities of 0.05-5% by weight, with respect to the total, preferably 0.1-3%. These catalysts are prepared by first depositing a cobalt salt on the inert carrier (silica or alumina), for example by means of the dry impregnation technique, followed by a calcination step and, optionally, a reduction and passivation step of the calcined product.

A derivative of tantalum (particularly tantalum alcoholates) is deposited on the catalytic precursor thus obtained, preferably with the wet impregnation technique followed by calcination and, optionally, reduction and passivation.

The catalyst, whatever its chemical composition may be, is used in the form of a finely subdivided powder having an average diameter of the granules ranging from 10 to 250 μm.

The catalyst, englobed in the paraffinic matrix, is brought to a temperature higher than or equal to 150° C., for example, from 150 to 220° C., and diluted with a diluent liquid at those temperatures, and also at room temperature, for example with an oligomer of $C_6$-$C_{10}$ α-olefins, until a concentration of solid ranging from 10 to 50% by weight is obtained. After the complete melting of the paraffinic matrix, the suspension is transferred into the reactor (B), maintained at a temperature higher than or equal to that of the melting vessel (A), by means of an internal heat exchanger. Under normal operating conditions, the exchanger serves for removing the reaction heat produced and maintaining the conditions more or less isothermal in the whole reaction volume.

During the transfer of the suspension, the reactor (B) is at a pressure lower than that present in the charging vessel (A) in order to favour the passage of the suspension from the vessel to the reactor due to the difference in pressure. The pressure in the charging vessel (A) is generally higher than that present in the reactor (B) by about 0.2-0.4 MPa whereas the pressure inside the reactor is maintained at about 0.1-1 MPa. For the whole duration of the transfer process, a stream of inert gas (5) is maintained at the bottom of the reactor (B) to guarantee the suspension of the catalyst, thus preventing its sedimentation.

Both the temperature and pressure present inside the reactor (B) during the charging phase are lower than the values present during regime synthesis conditions. The Fischer-Tropsch reaction is in fact carried out at temperatures equal to or higher than 150° C., for example ranging from 200 to 350° C., maintaining a pressure ranging from 0.5 to 5 MPa inside the reactor. More significant details on Fischer-Tropsch reactions are available in "Catalysis Science and Technology", vol. 1, Springer-Verlag, New York, 1981.

In order to reach the normal operating level inside the reactor (B) and all the optional apparatuses (E) envisaged for the treatment of the suspension, the melting, dilution and transfer from the charging vessel (A) to the reactor (B) are repeated various times. In relation to the concentration of the catalyst desired and plant production capacity, this operation can be repeated, for example, from 2 to 30 times.

During the first and subsequent charging steps, the reactor (B) is kept isolated from the optional equipment (E) envisaged for the treatment of the suspension, until an adequate suspension level is reached in the reactor itself enabling it to be on-line with said equipment (E). The charging steps are then completed until the normal operating level is reached. The vessels (A) and (B) have outlets (13) for the recovery of the vapour phase (inert gas and/or non-reacted synthesis gas, and/or synthesis reaction products in vapour phase under the reaction conditions).

At the end of the charging phase, before bringing the system to the normal reaction and production conditions (14), a conditioning phase of the catalyst is activated. More specifically, at the end of the charging, the reactor (B) is in temperature conditions ranging from 150 to 220° C.; and a pressure ranging from 0.1 to 1 MPa, and is continuously fed with inert gas. The conditioning phase of the catalyst comprises:

a) regulating the temperature and pressures at values suitable for the conditioning, i.e. within the range of 200-230° C. and 0.5-1.5 MPa;

b) gradually substituting the inert gas with synthesis gas, up to a concentration of inert gas ranging from 5 to 50% by volume and maintaining a partial water pressure (co-product of the Fischer-Tropsch synthesis reaction) lower than 1.0 MPa, preferably lower than 0.5 MPa, more preferably lower than 0.3 MPa;

c) maintaining the conditions of point (b) for 24-72 hours;

d) gradually increasing the pressure inside the reactor (B) up to regime values (0.5-5 MPa);

e) gradually reducing the concentration of inert gas to zero until regime conditions; and f) gradually increasing the reaction temperature until reaching regime values (200-350° C.).

Synthesis gas essentially consists of CO and $H_2$, possibly mixed with $CH_4$, $CO_2$ and inert gases in general; it has a $H_2$/CO molar ratio ranging from 1 to 3 and preferably derives from steam reforming and/or partial oxidation of natural gas or other hydrocarbons, on the basis of the reactions described, for example, in U.S. Pat. No. 5,645,613. Alternatively, the synthesis gas can derive from other productions techniques such as, for example, autothermal reforming, C.P.O. (Catalytic Partial Oxidation) or from the gasification of coal with water vapour at a high temperature as described in "Catalysis Science and Technology", vol. 1, Springer-Verlag, New York, 1981.

When the reactor (B) is under regime conditions, periodic make-up of the catalyst is envisaged for compensating losses (in activity and material) during the overall production cycle, for example due to purges effected in the liquid-solid separation section.

In order to carry out the make-up of the catalyst, it is not only necessary to effect the melting of the pellets and their possible dilution with a solvent, but it is also preferable to proceed with the conditioning of the fresh catalyst before introducing it into the reaction environment. There is therefore a specific melting and conditioning section for this function, described in the enclosed claims, which is essentially based on:

a vessel (C), equipped with an inlet for inert gas (3'), where the pellets of catalyst, after the addition of a solvent (8), are charged (7) and melted, similar to that adopted for the initial charging, preferably having smaller dimensions, which is run under the same conditions as those of the main charging vessel (A);

a reaction vessel (D), equipped with inlets for inert gas (5') and synthesis gas (6'), where the suspension is transferred (9) after melting, in which the catalyst undergoes the same conditioning process envisaged for the fresh catalyst used during the initial charging; said vessel (D) is designed for reaching higher pressures than those of the reactor (B) during normal operating conditions; after completing the conditioning procedure, in fact, the suspension is transferred (10) from the reaction vessel (D) to the main reactor (B) as a result of the pressure change.

The vessels (C) and (D) have outlets (13') for recovering the vapour phase (inert gas and/or non-reacted synthesis gas, and/or products of the synthesis reaction in vapour phase under the reaction conditions).

At the end of the conditioning phase of the catalyst and once the synthesis reactor (B) has been brought to regime conditions, the running of the latter can comprise a further two steps: stoppage (or shut down), with consequent re-start-up, and a temporary stoppage phase, better known as stand-by.

The shut-down of a reactor (B) in which reactions are effected which take place in multiphase systems, wherein a gaseous phase, prevalently consisting of CO and $H_2$, is bubbled into a suspension of a solid in the form of particles (catalyst) in a liquid (prevalently reaction product), requires the following operating phases:

i. gradual stoppage of the feeding of synthesis gas (6) and its gradual substitution with inert gas (5);

ii. possible reduction of the operating pressure and temperature inside the reactor (B) to values close to those of the conditioning phase;

iii. discharging (4) of the suspension contained in the reactor (B) and (11) in the units associated therewith (E) and its recovery in the vessel (A) heated and flushed with inert gas (3); the transfer is effected by means of the difference in pressure, the vessel (A) having been previously brought to a pressure at least 3 bars lower than the reactor (B).

According to the present invention, the inert gas can consist, for example, of nitrogen or, preferably, of purified natural gas.

In this embodiment of the present invention, once the suspension has been discharged from the reactor (B) and from the equipment (E) envisaged for the treatment of the suspension, such as degassing vessels and/or decanters and/or filters and other apparatuses such as recirculation pumps, and once the actions required for the shutdown phase have been completed, the reactor can be reactivated following the method described above, for example, for the charging phase.

The vessel (A) is designed to have a capacity which is such as to contain the volume of suspension present in the reactor (B) and in the other units (E), associated with the treatment of the suspension, at the moment of shut-down.

Should it not be necessary to empty the reactor (B) in the shut-down phase, in the case for example of a temporary stand-by phase, the latter comprises:

1. gradual stoppage of the feeding of the synthesis gas (6) and gradual substitution with inert and/or reducing gas, for example hydrogen (5) to keep the solid phase sufficiently dispersed in the suspension, at the same time minimizing any possible deactivation phenomena;
2. possible reduction in the operating temperature and pressure to values close to those of the conditioning phase.

In this phase, the reactor (B) can be kept in line with the treatment section of the suspension (E) which is completely recycled, (11) and (12), to the reactor without the extraction of products. Alternatively, the reactor can be taken off-line from the units (E) after removing the suspension from the equipment (E) directly connected to the reactor (B). The latter is preferably designed to have a capacity which is such as to also contain the volume of suspension present in the units (E) at the moment of temporary stand-by.

The invention claimed is:

1. A process for the shut-down of a reactor in which reactions take place in multiphase systems according to the Fischer-Tropsch technology, wherein a gaseous phase, comprising CO and $H_2$, is bubbled into a suspension of a solid in the form of particles in a liquid, which comprises the following operating phases:

i. gradually stopping the feeding of a synthesis gas and gradual substitution of the synthesis gas with a first inert gas;

ii. optionally reducing the operating pressure and temperature present inside the reactor; and iii. discharging of a suspension contained in the reactor and in units associated therewith, and its recovery in a vessel heated and flushed with a second inert gas, wherein the transfer is effected by a difference in pressure, the vessel having been previously brought to a pressure at least 3 bars lower than the reactor.

2. The process according to claim 1, wherein the vessel is designed to have a capacity which is sufficient to contain the volume of suspension present in the reactor and in said units, associated with the treatment of the suspension, at the moment of shut-down.

3. A process for the running of a temporary shut-down phase of a reactor wherein reactions are effected which take place in multiphase systems according to the Fischer-Tropsch technology, wherein a gaseous phase, comprising CO and $H_2$, is bubbled into a suspension of a solid in the form of particles in a liquid, which comprises:

1. gradually stopping the feeding of a synthesis gas and gradual substitution with inert and/or reducing gas to keep the solid dispersed in the suspension; and
2. optionally decreasing the operating temperature and pressure.

4. The process according to claim 3, wherein the reactor is kept on-line with a treatment section of the suspension which is completely recycled to the reactor without the extraction of products.

5. The process according to claim 3, wherein the reactor is taken off-line from the treatment section after emptying the suspension from the treatment section directly connected to the reactor.

6. The process according to claim 5, wherein the reactor has a capacity which is sufficient to also contain the volume of suspension present in the treatment section at the moment of temporary shut-down.

7. The process of claim 1, wherein the process comprises reducing the operating pressure and temperature present inside the reactor.

8. The process of claim 3, wherein the process comprises decreasing the operating temperature and pressure.

9. The process of claim 1, wherein the first and/or second inert gas is nitrogen or purified natural gas.

10. The process of claim 3, wherein the inert and/or reducing gas is hydrogen.

* * * * *